US008439854B2

(12) United States Patent
Terrio

(10) Patent No.: US 8,439,854 B2
(45) Date of Patent: May 14, 2013

(54) ANKLE REHABILITATION DEVICE

(76) Inventor: Timothy Terrio, Bakersfield, CA (US)

( * ) Notice: Subject to any disclaimer, the term of this patent is extended or adjusted under 35 U.S.C. 154(b) by 546 days.

(21) Appl. No.: 12/765,289

(22) Filed: Apr. 22, 2010

(65) Prior Publication Data

US 2010/0274163 A1 Oct. 28, 2010

Related U.S. Application Data

(60) Provisional application No. 61/214,383, filed on Apr. 22, 2009.

(51) Int. Cl.
*A61H 1/02* (2006.01)
*A63B 21/02* (2006.01)

(52) U.S. Cl.
USPC ..... 601/27; 601/33; 482/79

(58) Field of Classification Search ..... 601/23, 601/24, 27, 32, 33, 34, 35; 482/79, 80, 93, 482/94, 97, 98, 105
See application file for complete search history.

(56) References Cited

U.S. PATENT DOCUMENTS

| | | | | |
|---|---|---|---|---|
| 3,020,046 | A * | 2/1962 | Hotas | 482/79 |
| 4,337,939 | A * | 7/1982 | Hoyle et al. | 482/79 |
| 5,722,919 | A * | 3/1998 | Timmer | 482/79 |
| 6,878,102 | B1 * | 4/2005 | Commisso | 482/79 |

* cited by examiner

*Primary Examiner* — Quang D Thanh
(74) *Attorney, Agent, or Firm* — James M. Duncan, Esq.; Klein, DeNatale, Goldner, Cooper et al.

(57) ABSTRACT

An ankle therapy device provides variable loading on targeted muscles and tendons, by utilizing a variable length moment arm to which the load is attached, and having the ability to change the angle of the load with respect to the orientation of the user's foot. Thus, the device provides a variable resistance on the ankle muscles and tendons when the ankle is moved, and may target different muscles and tendons by changing the angle of the resistance. The device comprises a member to which the user's foot is attached, and a rotatably attached weight support member to which a weight is secured. The position of the weight may be shifted along the length of the weight support member, and the amount of weight may be changed.

8 Claims, 3 Drawing Sheets

ANKLE REHABILITATION DEVICE

CROSS-REFERENCE TO RELATED APPLICATION

U.S. Provisional Application No. 61/214,383 for this invention was filed on Apr. 22, 2009, for which application this inventor claims domestic priority.

BACKGROUND

The disclosed apparatus generally relates to devices used during physical rehabilitation and specifically to devices used in physical rehabilitation directed towards strengthening the leg muscles, calves, and the ankle.

It is known to use various exercising devices for the purpose of rehabilitating or conditioning the muscles and tendons associated with the ankle joint. Typically, these devices involve a shoe-like apparatus designed to be attached to a person's foot and the shoe is then mounted to a load inducing machine or piece of equipment so that the person's ankle joint can be maneuvered in different ways against the resistance produced by the equipment.

Although these devices serve the purpose of enabling movement of the person's ankle against a resistance load to effect a strengthening or conditioning of the ankle, the simpler form of these devices are generally not adequate to the task of rehabilitating ankles where specific muscles or tendons are targeted for strengthening or conditioning. The devices which are capable of targeting specific muscles or tendons are generally difficult to use, are cumbersome, and are limited to use in controlled environments under the supervision of a therapist.

BRIEF DESCRIPTION OF THE INVENTION

The disclosed device may be utilized for targeting specific muscles and tendons of the ankle by proving a load which may be pivoted about the ankle at a large range of angles. The disclosed device provides variable loading on targeted muscles and tendons, by utilizing a variable length moment arm to which the load is attached. Thus, the device provides a variable resistance on the ankle muscles and tendons when the ankle is moved, and may target different muscles and tendons by changing the angle of the resistance. The device comprises a foot retention member and a weight support member, with the weight support member comprising a removable weight. The weight support member is be rotatable relative to the foot retention member. The foot retention member comprises foot attachment means such as straps or bindings to retain the user's foot against the foot retention member.

The weight support member may comprise a slot to which a weight may slidingly be attached, and selectively locked at different positions along the slot. The slot may comprise such length that the weight may be placed at a variety of different locations along the slot, thereby providing for variable resistance through movement of the weight away from the ankle to increase resistance and closer to the ankle to decrease resistance. The weight support member may comprise a locking or retention means to hold the weight in place at the desired location along the slot. The weight may be removable so that the ankle rehabilitation device may be used alone in the initial stages of rehabilitation, and the weight may comprise a single weight or stackable units.

DETAILED DESCRIPTION

Figure 1:
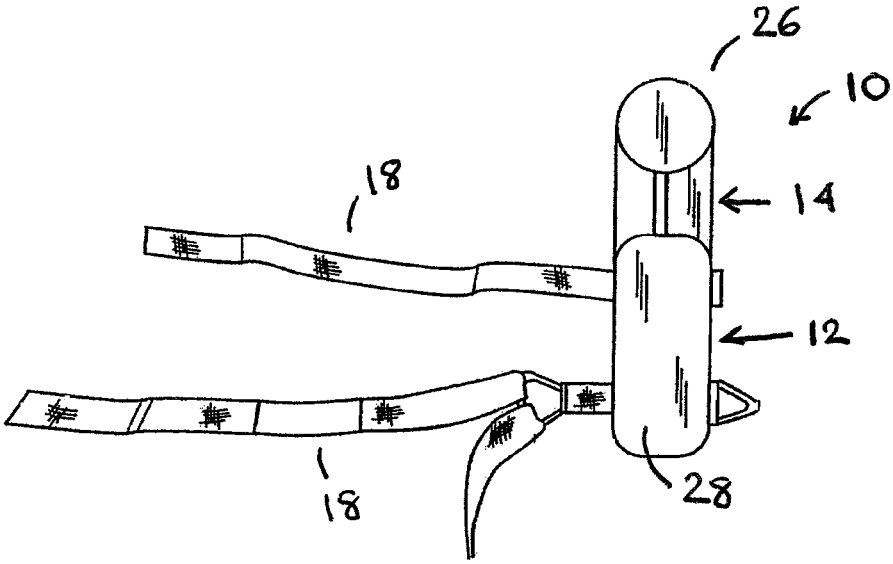
FIG. 1 shows a top view of an embodiment of the present ankle rehabilitation device, in which the foot retention member and the weight support member are in axial alignment.
Figure 2:
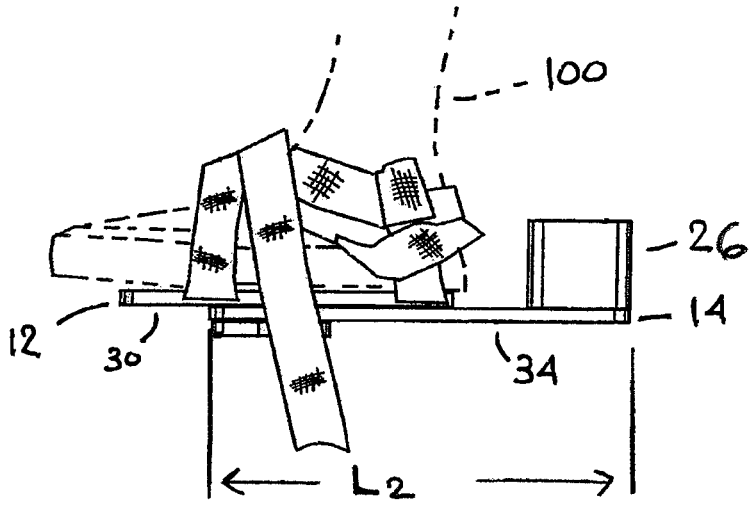
FIG. 2 shows a side view of an embodiment of the ankle rehabilitation device, showing one means for attached the device to the foot of a user.

Referring now to the Figures, FIGS. 1 through 7 show various views of embodiments of the disclosed ankle rehabilitation device. Embodiments of the ankle rehabilitation device 10 comprise a foot retention member 12, a weight support member 14, and a weight 26. The foot retention member comprises a first top surface 28, a first bottom surface 30, a first length $L_1$ which defines a first axis $A_1$, and a first width $W_1$.

The foot retention member 12 further comprises foot attachment means such as straps 18, bindings, or an integral shoe, to retain the users foot 100 against the foot retention member 12.

Weight support member 14 comprises a second top surface 32, a second bottom surface 34, a second length $L_2$ which defines a second axis $A_2$, and a second width $W_2$. The weight support member 14 is rotatably attached to the foot retention member 12 by a pivoting means such as a stud 20, bolt, bushing, or other attachment means which enables the weight support member 14 to be rotated around the foot retention member 12. Foot retention member 12 may comprise stud 20 which extends out from the bottom surface 30, where it can be engaged by handle 22 or other device having threads corresponding to those of stud 20, such that handle 22 may be tightened against stud 20, thereby locking the position of the weight support member 14 in the desired location with respect to the foot retention member. Because weight support member 14 is pivotable a full 360 degrees about foot retention member 12, the weight support member may be locked with respect to the foot retention member in almost any angular position from 0 to 359 degrees, where the angular position is defined by the position of the first axis $A_1$ with respect to the second axis $A_2$. The rotational mounting allows the weight support member 14 to rotate fully so that the toes, heel, or either side of the foot may face the weight support member 14. This rotation allows the ankle rehabilitation device 10 to be used for exercises stretching and strengthening the ankle and associated muscles in all directions.

Figure 3:
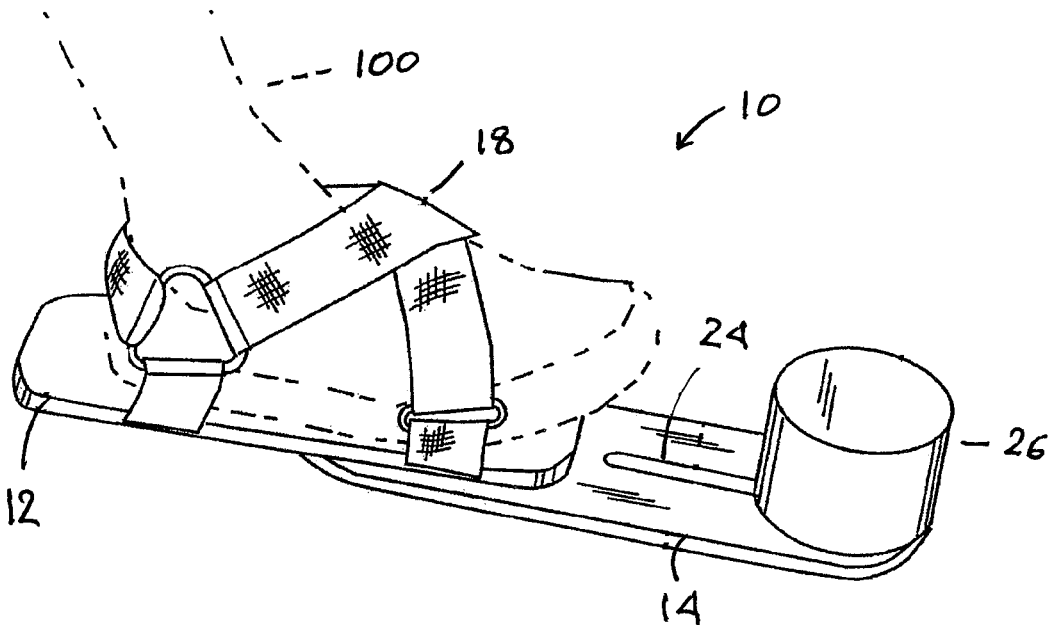
FIG. 3 shows a perspective view of an embodiment of the ankle rehabilitation device attached to the foot of a user.
Figure 4:
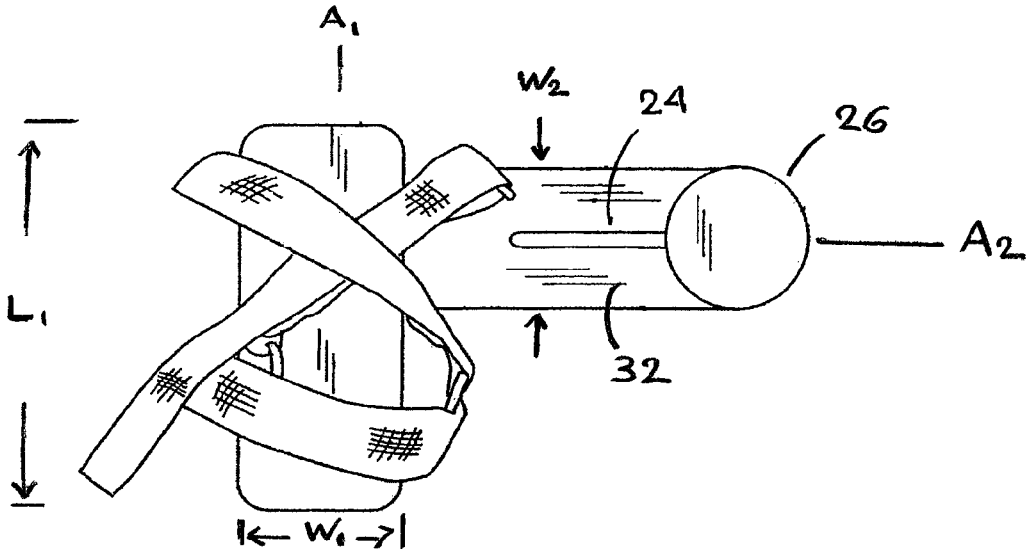
FIG. 4 shows another top view of an embodiment of the ankle rehabilitation device in which the angle between the foot retention member and the weight support member are approximately 45 degrees.
Figure 5:
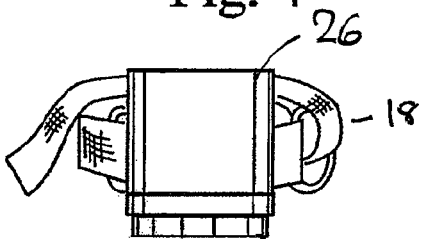
FIG. 5 shows a view of an embodiment of the ankle rehabilitation device, looking toward the weight.
Figure 6:
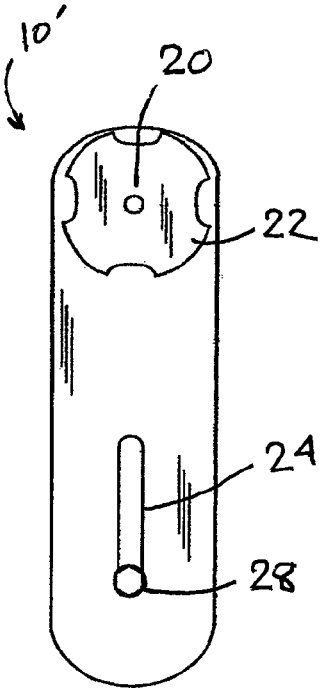
FIG. 6 shows a bottom view of an embodiment of the ankle rehabilitation device.
Figure 7:
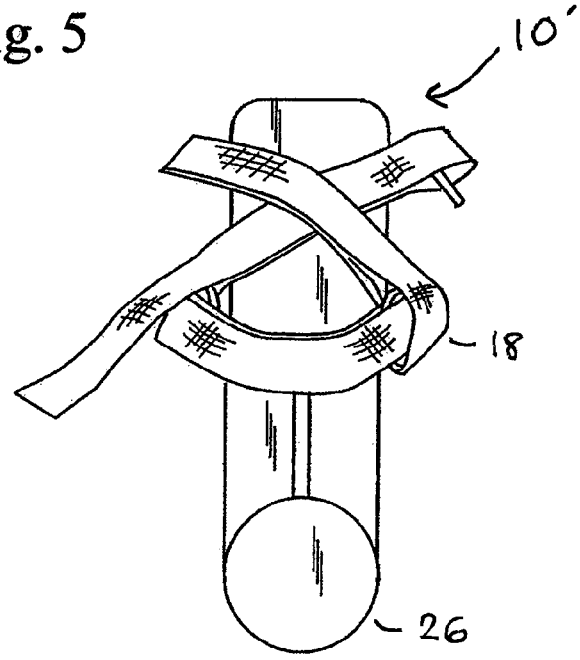
FIG. 7 shows a top view of the embodiment of the ankle rehabilitation device shown in FIG. 6.

The weight support member 14 comprises a slot 24 to which one or more weights 26 may be attached. Slot 24 will generally fully penetrate from the second top surface 32 to the second bottom surface 34. Slot 24 may be elongate, and transverse approximately half of the second length $L_2$ of the weight support member 14. Slot 24 may also be centrally positioned with respect to second width $W_2$. The elongate slot 24 allows the weight 26 to be placed at different locations along the elongate slot 24, so that the weight support member 14 may be placed closer to or further from the foot retention member 12 and the user's foot 100. The placement of the weight 26 in relation to the foot retention member 12, and therefore the user's foot 100, allows the device to provide a multiplicity of therapeutic treatments, because it changes the amount of effort required to lift the ankle depending upon the position of the weight. The placement of the weight 26 along the slot 24 changes the length of a moment arm which is acted upon by weight 26, such that the moment is increased the further the weight is shifted forward in the slot. For example, FIG. 3 illustrates the weight 26 fully forward in the slot 24, thus imposing a larger moment on the foot 100 than if the weight were pushed back toward the foot The weight support member 14 may comprise a lockable or compressible retention means 28, such as, for example, a locking bolt, extending through the weight 26 and the slot 24, thereby connecting the weight 26 and the slot 24 together to hold the weight 26 in place at the desired location along the slot 24. The weight 26 further may be removable so that the ankle rehabilitation device may be used without the weight 26 in the initial stages of rehabilitation. The weight 26 may comprise a single weight or stackable units so that the weight may be increased or decreased depending upon the user's level of rehabilitation, fitness, and the physical rehabilitation regimen being followed. Once the amount of weight 26 to be used is determined, that amount of weight may be secured together as a series, or provided by a single weight, to produce the desired load or resistance. This resistance is accomplished by having the excess weight 26 at the end of a long lever, thereby multiplying the actual weight. This increased load caused by the leverage, will produce enough resistance to fatigue the strong ankle muscles.

The disclosed device provides isotonic, or muscle shortening, exercise through a load or weighted resistance to the ankle joint. It increases the strength of the muscles and tendons that surround the joint, thereby increasing the range of motion. The ankle is a complex joint that is capable of moving in multiple planes. This device allows the user to independently focus on and strengthen the ankle in all of its singular planes of movement as well as the multiple plane movements. The device also provides for use to passively stretch the affected muscles and tendons, thereby relieving a therapist or other person from involvement in stretching the user's leg and ankle muscles.

The strengthening exercises employed with this device are non-weight bearing, unlike weight-bearing exercises where the foot of the rehabilitation apparatus is in contact with the ground. Generally, employing non-weight bearing exercises allows for rehabilitation at an earlier stage in recovery. The user straps the foot retention member onto the foot of the affected ankle, and then hangs that foot off the edge of a table or other surface. The chosen exercises or stretches are performed, and by lying on the back, sides or stomach, the user exercises the appropriate muscles and tendons by performing single- or multi-plane movements of the ankle.

While the above is a description of various embodiments of the present invention, further modifications may be employed without departing from the spirit and scope of the present invention. Thus the scope of the invention should not be limited by the specific structures disclosed. Instead the true scope of the invention should be determined by the following appended claims.

What is claimed is:

1. An ankle strengthening apparatus for attaching to a user's foot, the apparatus comprising:

a foot retention member having a first top surface, a first bottom surface, a first length defining a first axis, and a first width, the foot retention member comprising means for attaching to the user's foot;

a weight attachment member rotatably attached to the foot retention member, the weight attachment member having a second top surface, a second bottom surface, a second length and a second width, the second length defining a second axis, the weight attachment member rotatable through a plurality of angular positions with respect to the foot retention member, each angular position having an angle that is defined by a position of the first axis with respect to the second axis, the angle ranging from 0 to 359 degrees;

a first locking means for selectively locking the angle of the first axis with respect to the second axis;

the weight attachment member further comprising a slot in axial alignment with the second axis, the slot fully penetrating from the second top surface to the second bottom surface; and a weight slideably attached to the slot with a fastening or second locking means for locking a position of the weight with respect to the slot, wherein the weight is moveable along a length of the slot.

2. The ankle strengthening apparatus of claim 1 wherein the means for attaching to the user's foot comprises a strap.

3. The ankle strengthening apparatus of claim 1 wherein the slot is centrally positioned with respect to the second width.

4. The ankle strengthening apparatus of claim 1 wherein the slot comprises a length extending approximately half of the second length.

5. The ankle strengthening apparatus of claim 1 wherein the first locking means comprises a threaded lock nut.

6. The ankle strengthening apparatus of claim 1 wherein the second locking means comprises a locking bolt inserted through the slot into the weight.

7. The ankle strengthening apparatus of claim 1 wherein the weight comprises a plurality of stackable weight units.

8. The ankle strengthening apparatus of claim 1 wherein the first length is sufficiently long for disposition for most of the user's foot on the first top surface.

* * * * *